United States Patent [19]

Junod

[11] 4,096,902

[45] Jun. 27, 1978

[54] DOOR WITH FLEXIBLE WOUND SECTIONS

[76] Inventor: Louis Junod, 78, rue des Moulins, 1400 Yverdon, Switzerland

[21] Appl. No.: 694,946

[22] Filed: Jun. 11, 1976

[30] Foreign Application Priority Data

Jun. 13, 1975 Switzerland ..... 7682/75

[51] Int. Cl.[2] ..... E06B 9/08

[52] U.S. Cl. ..... 160/122; 160/241

[58] Field of Search ..... 160/120, 122, 291

[56] References Cited

U.S. PATENT DOCUMENTS

| | | | |
|---|---|---|---|
| 490,448 | 1/1893 | Lugrin | 160/120 |
| 520,065 | 5/1894 | Lugrin | 160/122 |
| 2,417,482 | 3/1947 | Gacki | 160/120 |
| 2,668,586 | 2/1954 | Luckie | 160/241 |
| 3,386,489 | 6/1968 | Denton et al. | 160/241 |

*Primary Examiner*—Peter M. Caun

*Attorney, Agent, or Firm*—Robert E. Burns; Emmanuel J. Lobato; Bruce L. Adams

[57] ABSTRACT

A door comprises two flexible door panels or sections wound on tubes on opposite sides of a door frame. Uprights at the free edges of the door sections are supported and driven in opposite directions by toothed belts driven by a driving shaft extending through one of the winding tubes, the other tube having a similar shaft driven in the opposite direction by a reversing mechanism, the tube of each flexible door section being connected to its shaft by a spring barrel maintaining the door section under tension.

8 Claims, 5 Drawing Figures

FIG. 1a
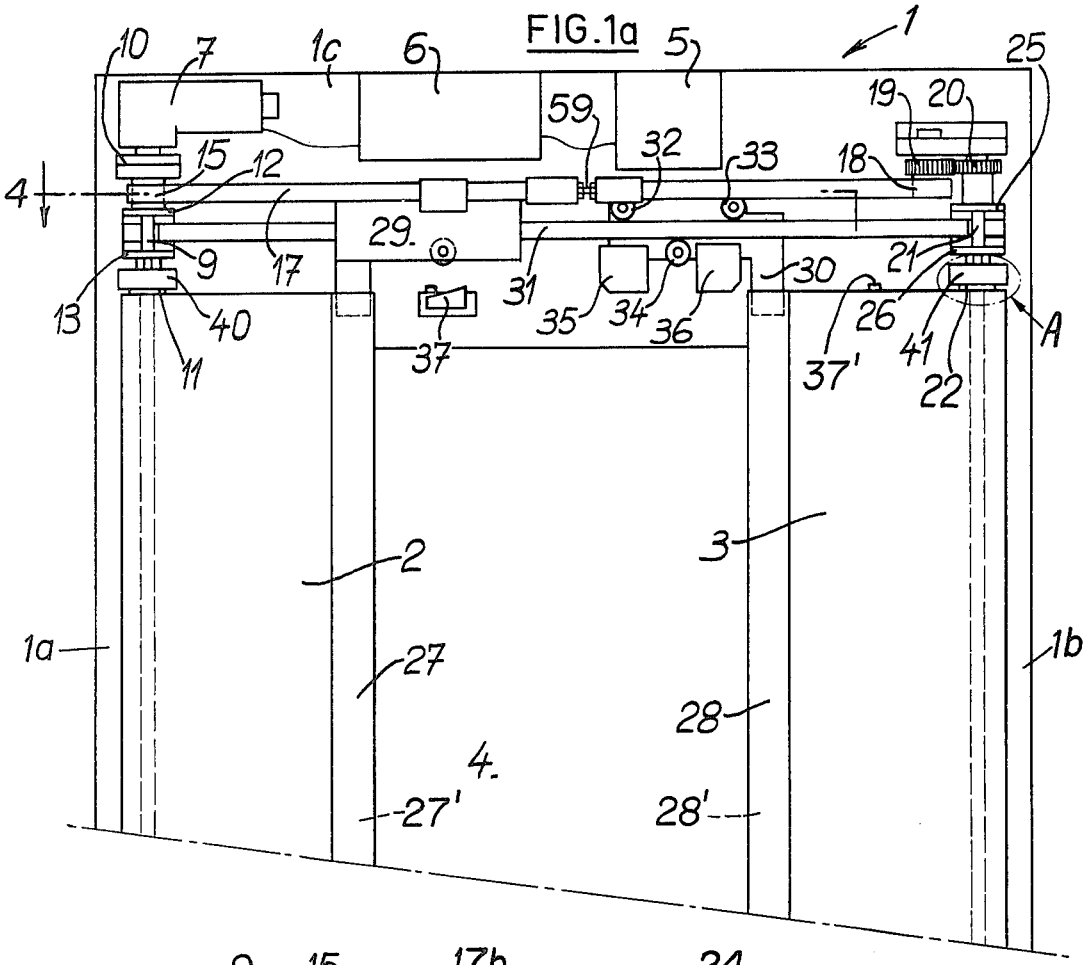
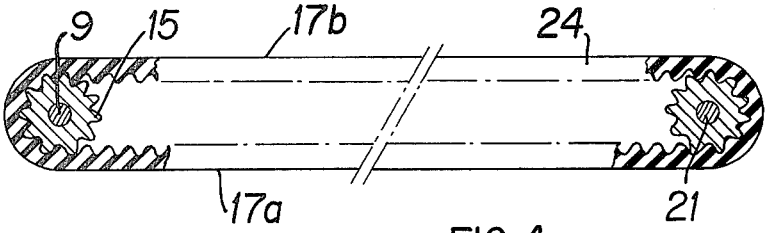
FIG. 4
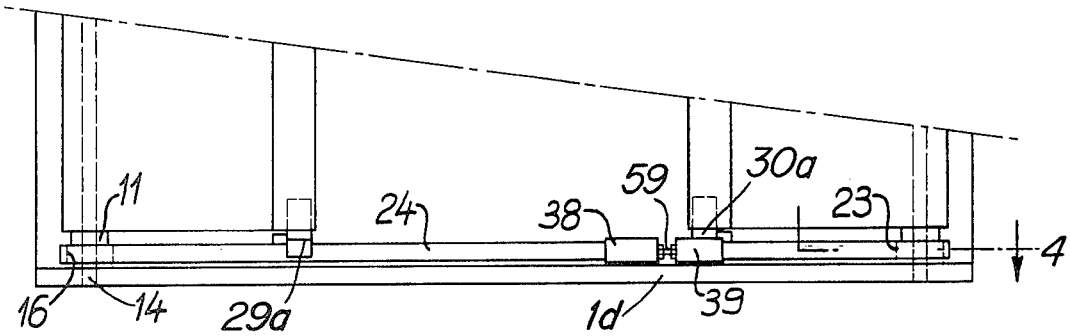
FIG. 1b

DOOR WITH FLEXIBLE WOUND SECTIONS

The invention relates to doors of the type comprising at least one flexible door section or panel wound on a winding tube rotatably mounted on one side of a door frame and submitted to the action of elastic means tending to wind the flexible door section on the winding tube, the other edge of the flexible door section being connected to a rigid upright movable in translation and at least one of the ends of which is connected to driving means including a motor, and means for synchronizing the movements of the two ends of the upright.

In a known door of this type with two flexible door sections, the door sections are driven by small rods connected to a cycle chain and the movements of the uprights are synchronized by pinions mounted on the ends of two shafts fixed to the respective uprights and rolling along fixed horizontal racks. The flexible door sections are wound on their tubes by spring winders attached to cables, the other end of each cable being connected to the upright of the other door section. However, this arrangement does not provide a good synchronization between the movements of the ends of the mobile uprights. If the lower part of an upright is obstructed, its upper part may continue its movement and jam the door or cause it to move out of its guide means. The absence of a direct connection between the two door sections is also detrimental to good synchronization of their movements. Additionally, the cable of the winder is difficult to fit and no means are provided for adjusting it.

An object of the invention is to provide a door of the stated type which has simple and easy-to-assemble means providing a practically perfect synchronization, in these respects, and in which adjustment means may easily be incorporated.

SUMMARY OF THE INVENTION

According to the invention, in a door of the stated type, the upper end of each upright is fixed to a first toothed belt driven by a first pinion fixed on a driving shaft passing through the respective winding tube, the lower end of the driving shaft carrying a second driven pinion driving a second toothed belt to which the lower end of the upright is fixed. An elastic means, tending to wind the corresponding flexible door section on the respective winding tube, is provided by a stressed elastic coupling acting between the driving shaft and the winding tube.

BRIEF DESCRIPTION OF THE DRAWING

The accompanying drawings show, by way of example, an embodiment of the invention. In the drawings:

FIGS. 1*a*, 1*b* jointly are an elevational view of a door with two flexible door sections, shown with the door sections half opened and with the normally concealed driving mechanism visible;

FIG. 4 is a partial, sectional view, taken along line 4—4 in FIG. 1*a*, 1*b*.

DESCRIPTION OF THE PREFERRED EMBODIMENT

Figure 2:
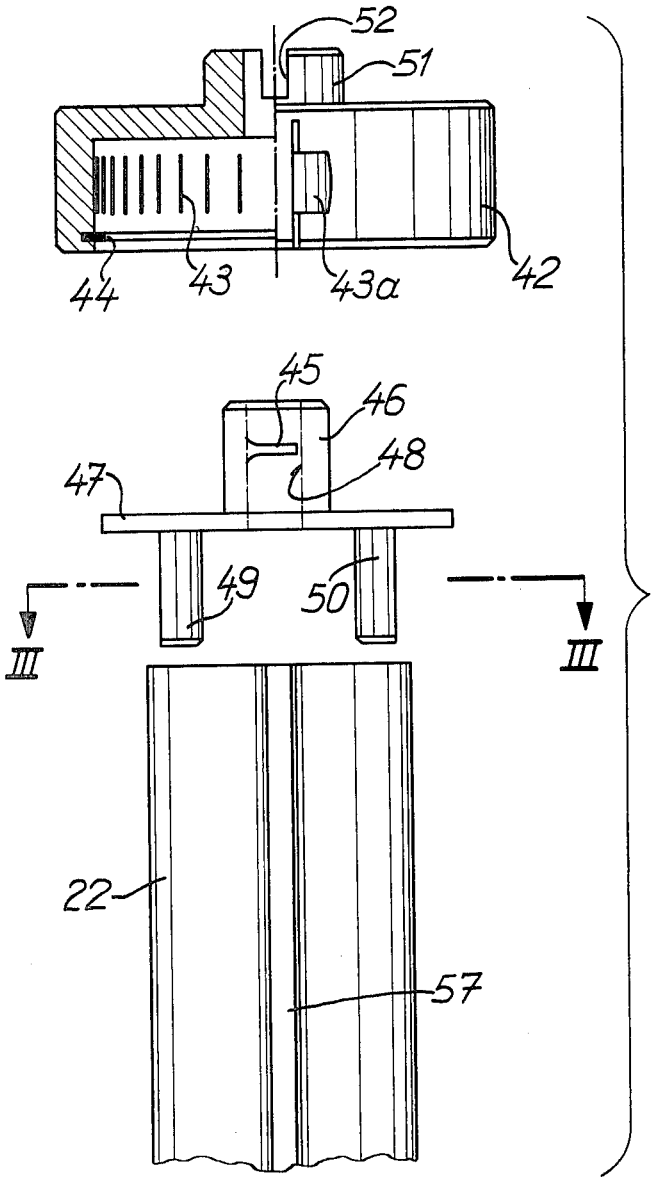
FIG. 2 is an exploded elevational view, partly in cross-section, of an elastic coupling of this door.

The door shown in FIGS. 1*a*, 1*b* comprises basically a rectangular, vertical metal frame 1 having sides 1*a*, 1*b*, top 1*c* and bottom 1*d*. Two flexible door panels or sections 2, 3 are aligned with one another in the plane of the drawing, and which when opened leave an opening 4 in the frame 1. The frame 1 is of box-like structure and it is normally closed by panels or profiled sections, not shown, concealing the mechanism so that only the door sections 2, 3 are visible.

In the upper part of frame 1 are mounted, as parts of an electrical drive system, a source of electrical current, shown as a transformer 5 providing a low voltage (e.g. 24V) from a mains supply. This source is shown as connected, through a relay box 6, to a reducing motor 7 operating at the low voltage (e.g. 24V) and driving a first vertical shaft 9 by the intermediary of an electromagnetic clutch 10. The shaft 9 passes all the way to the lower part of the frame, through a first winding tube 11, on which the first flexible door section 2 is wound. The upper end of shaft 9 is supported in bearings 12 and 13, and its lower end 14 pivots in the base of frame 1. The shaft 9 also serves to support the winding tube 11, as will be described in detail later. Referring also to FIG. 4: on the shaft 9 are fixed an upper pinion 15 and a lower pinion 16. The upper pinion 15 drives a first toothed belt 17 passing about a sprocket pinion 18 located at the other side of frame 1. Pinion 18 is identical to pinion 15 and drives, via a reversing mechanism formed by two pinions 19 and 20, a second vertical shaft 21 passing through a second winding tube 22 on which the second door section 3 is wound. Shaft 21 is supported by bearings 25, 26, and is pivoted at its lower end in the frame, in the same manner as shaft 9. Shaft 21 also carries a pinion 23 at its lower end, as shaaft 9 does at 16, but pinion 23 is freely rotatably mounted on the shaft 21. It serves as a return device for a second toothed belt 24, driven by pinion 16. To facilitate assembly, the shafts 9, 21 can each be formed by two parts, fitted together between the bearings 12, 13 and 25, 26 respectively, although each shaft is shown as a single piece.

The free and mutually facing edge portions 27', 28' of the flexible door sections 2, 3 are fixed to mobile uprights 27, 28. The first upright 27, provided for the first door section 2, is fixed at its upper end to a carriage 29 fixed on the front run 17*a*, of belt 17 (looking at FIG. 1), and similarly at its lower end to the front run of belt 24 by a connector 29*a*. Correspondingly, the upper end of upright 28 is fixed to a carriage 30 fixed to the rear run 17*b* of belt 17, and its lower end similarly to the rear run of belt 24 by a connector 30*a*. The carriages 29, 30 move respectively along a front rail 31 and a rear rail (not shown) located behind rail 31, engaging these rails by upper supporting rollers 32, 33 and a lower guide roller 34. The rails are formed by flat-oval steel bars and are spaced apart so that the carriages 29, 30 can pass by one another as the door closes. Carriage 30 carries two cams 35 and 36 cooperating respectively with end-of-path switches such as 37, 37'. The electrical circuitry is not shown in detail as it is of a type well known to persons skilled in the art.

The toothed belts 17 and 24 are each equipped with a tension adjusting device formed by a threaded rod 57 screwed in two metallic pieces 38 and 39 fixed to the ends of the belt. This simple and efficient tensioning device is placed so that it moves only with a to-and-fro movement between the pinions without passing about the pinions.

The resulting use of perfectly taut toothed belts, together with the use of pinions 15 and 16 driven by the same shaft 9, and of the rigid connections 29, **29*a*, 30, 30*a* of the uprights 27, 28 of the flexible door sections to the toothed belts 17, 24**, ensures perfect synchronization of the movements of the upper and lower ends of both mobile uprights, and thereby ensures proper, non-jamming movement of the flexible door sections relative to one another.

Figure 3:
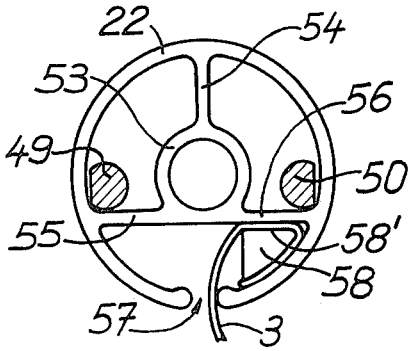
FIG. 3 is a cross-section along line III—III of FIG. 2 of the assembled coupling.

The flexible door sections 2 and 3 are wound on their winding tubes. Thus the two sections are held flat, in a vertical plane, at a given tension between those tubes and the respective uprights, during the winding up and reverse rotation or unwinding, and in the resulting open, partly open, or closed positions of the door. This is achieved by two identical elastic coupling devices 40, 41, one of which is shown in detail in FIGS. 2 and 3. Each coupling device comprises a barrel 42 having an open bottom and housing a spiral spring 43 retained against downward loss from the barrel by a split ring 44, an outer end **43*a* of the spring being secured to the cylindrical wall of the barrel whereas its inner end hooks in a slot 45 of a spigot 46 integral with a cover disc 47 and having a bore 48 through which the respective shaft passes. The cover disc 47 has two projecting studs 49, 50 each with an external flat, these studs engaging in the winding tube, for example 22, as shown in FIG. 3, to rigidly couple the spigot 46 and tube 22 for rotation together. The barrel 42 has an integral hub 51 by means of which it is mounted on the driving shaft, hub 51 having a slot 52 for receiving a pin, not shown, which can pass through and projects from the driving shaft. The spring 43 can be set at a desired tension by turning the barrel 42 in relation to tube 22** in a chosen position by engaging it on the projecting pin.

The cross-sectional profile of one of the winding tubes, for example 22, is shown in FIG. 3. These tubes, which are formed by extrusion, comprise a central tubular guide 53 in which the driving shaft passes freely, without play, and three ribs 54, 55, 56 connecting guide 53 to an outer tube on which the flexible door section is wound. This outer tube has a longitudinal slot 57, the edge parts of the outer tube adjacent slot 57 defining, with the ribs 55, 56, a housing in which the end or edge portion 58' of a flexible door section, for example 3, is jammed by a wedged 58, thereby fastening this end in other words, the edge portion of the door section, other than the edge portion fixed to the corresponding upright 28 - to the winding tube. The barrel 42, spigot 46 and winding tube, for example 22, are fitted together without any auxiliary means such as screws or rivets. These pieces are thus easy to assemble and dismantle, which greatly facilitates repairs.

An important security feature of the described door is that in the event of a breakdown in the current supply, the electromagnetic clutch 10 is no longer energized and the driving shaft is uncoupled, which enables the door to be opened and closed by hand without any difficulty.

Two doors each with two door sections 2, 3 as shown, can be combined with their motors 7 and relays 6 interconnected by circuit means, not shown here but obvious to persons skilled in the art, so that each door can only open when the other is closed, thus forming a draught-excluding double door which is particularly useful in hospitals and laboratories.

What is claimed is:

1. A door comprising;

a door frame having two side members, a top member and a bottom member jointly generally defining a vertical plane;

a pair of flexible door sections, aligned with one another in said plane, each section having a vertical winding tube rotatably mounted and extending along one of the sides of the frame, each section also having a first vertical edge portion secured to the respective winding tube so that the section can be wound on the tube, and having a second and free vertical edge portion;

two rigid uprights each extending along and secured to the free vertical edge portion of one of the flexible door sections;

a mounting, driving and synchronizing system for the two uprights, comprising (a) an upper toothed belt disposed adjacent and along the top of the frame and fixed to upper ends of the two uprights, the belt being movable to synchronously move the upper ends in mutually opposite directions in said plane, and a lower toothed belt disposed adjacent and along the bottom of the frame, fixed to lower ends of the two uprights, and movable to similarly move the lower ends, (b) a driving shaft rotatably mounted at the top and bottom of the frame, extending through and supporting one of the winding tubes, and having upper and lower drive wheels secured to the shaft near upper and lower ends, respectively, of the winding tube supported by the shaft, for driving the upper and lower toothed belts, (c) a driven shaft and drive wheel means similarly mounted and having means for driving them by the belts; and (d) motor means for reversibly rotating the driving shaft;

two carriages, one secured to the upper end of each upright and each secured to the upper toothed belt;

rail means for supporting and guiding the carriages to keep the flexible door sections in said vertical plane, and a pair of elastic biasing couplings, each interposed and acting between one of the shafts and the respective winding tube for biasing the respective tube and first vertical edge portion towards winding said portion and the respective door section onto the tube to keep the flexible door sections flat in said vertical plane while the uprights and free edge portions are reversibly driven by the motor, drive shaft and belts toward the sides of the frame, and while the door sections are held in resulting positions.

2. A door according to claim 1, wherein each winding tube is an extruded profile, comprising; a central tube; an outer tube coaxial therewith; and ribs integrally interconnecting the central and outer tubes; one of the shafts passing freely but without play through the central tube, and the outer tube having means defining a longitudinal slot, and receiving the first edge portion of the respective flexible door section, for securing the received edge portion to the outer tube.

3. A door according to claim 1, wherein each elastic coupling comprises a barrel secured to the driving shaft for rotation therewith; a cover fitted on the respective winding tube for rotation therewith; a spigot integral with the cover, inserted in the barrel, and having a bore through which the respective driving shaft passes; and a spiral spring having one end connected to the barrel and another end connected to the spigot to elastically interconnect the barrel with the spigot.

4. A door according to claim 3, wherein each winding tube comprises a central tube and, coaxially secured thereto, an outer tube, the cover having projecting studs which engage in the outer tube so as to rotationally secure the cover to the winding tube while permitting axial separation thereof for disassembling and reassembling the tube and cover.

5. A door according to claim 1, wherein each toothed belt has a device incorporated therein for tensioning the belt between the respective drive wheels.

6. A door according to claim 1, in which the means for driving the driven shaft and pinion means comprises a sprocket engaged and driven by the first toothed belt, and a reversing drive driven by said pinion for driving the driven shaft.

7. A door according to claim 6, in which the drive wheel means mounted for driving them by the belts comprises an upper gear secured to the driven shaft and constituting a part of the reversing drive, and a lower sprocket freely rotatably mounted on the driven shaft and engaged by the lower toothed belt.

8. A door according to claim 1, wherein one toothed belt has parallel first and second runs superimposed over the other belt, the upright of one of the flexible door sections being secured to the first runs and the upright of the other section being secured to the second runs.

* * * * *